United States Patent [19]

DeJean

[11] Patent Number: 4,911,319

[45] Date of Patent: Mar. 27, 1990

[54] PAINT CAN ATTACHMENT

[76] Inventor: Milton V. DeJean, 59 Danebury Downs, Upper Saddle River, N.J. 07458

[21] Appl. No.: 331,456

[22] Filed: Mar. 31, 1989

[51] Int. Cl.[4] ..... B65D 25/48

[52] U.S. Cl. ..... 220/4 A; 220/85 SP; 220/90; 222/567; 222/570

[58] Field of Search ..... 220/85 A, 85 SP, 90, 220/4 A; 15/246; 248/110; 222/570, 567

[56] References Cited

U.S. PATENT DOCUMENTS

| | | | |
|---|---|---|---|
| 1,191,464 | 7/1916 | Record | 222/567 |
| 2,639,835 | 5/1953 | Nelson | 220/90 |
| 2,674,391 | 4/1954 | Davis | 220/90 |
| 2,699,882 | 1/1955 | Lieb | 220/90 |
| 2,873,881 | 2/1959 | Nichols | 220/90 |
| 2,903,154 | 9/1959 | Hendershot | 220/90 |
| 2,943,761 | 7/1960 | Monier | 220/90 |
| 2,960,257 | 11/1960 | Sasse | 220/90 |
| 3,120,912 | 2/1964 | Mount et al. | 222/567 |
| 3,341,061 | 9/1967 | Cortina | 220/90 |
| 3,430,804 | 3/1969 | Bernas | 222/567 |
| 3,672,547 | 6/1972 | Kozlowski | 222/567 |
| 3,853,249 | 12/1974 | Weir | 222/570 |
| 3,899,107 | 8/1975 | Gaal | 220/90 |
| 4,203,537 | 5/1980 | McAlister | 220/90 |
| 4,240,568 | 12/1980 | Pool | 220/85 SP |
| 4,736,874 | 4/1988 | Durant | 222/567 |

FOREIGN PATENT DOCUMENTS

| | | | |
|---|---|---|---|
| 2163123 | 2/1986 | United Kingdom | 248/110 |

*Primary Examiner*—Stephen Marcus
*Assistant Examiner*—Stephen Castellano
*Attorney, Agent, or Firm*—Vidas & Arrett

[57] ABSTRACT

A paint can attachment which fits into the rim channel around the open top of a paint can. A sloped ring shaped surface extends slightly into the can flush with the inner peripheral edge of the can to prevent paint from getting into the rim channel. A pourer spout may be attached for ease of pouring paint. A paint scraper bar may be attached for scraping excess paint off brushes.

8 Claims, 2 Drawing Sheets

PAINT CAN ATTACHMENT

BACKGROUND OF THE INVENTION

1. Field of the Invention

This invention relates generally to attachments for paint cans, and more specifically to a three piece attachment which prevents paint from accessing the rim channel of the open paint can, provides a pourer spout, a paint brush scraper bar, and a splash guard.

2. Description of the Related Art

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

U.S. Pat. No. 3,221,955 entitled "Paint Can Protective Attachment", issued Dec. 7, 1965, is directed to an attachment which snap fits onto the brim of a paint can. The attachment has a dished rim portion and a forwardly extending pouring spout. The inner edge of the rim portion has a sharp edge which allows the painter to wipe or scrape excess paint from the brush.

U.S. Pat. No. 3,400,867 entitled "Spout Attachment For Paint Containers", issued Sept. 10, 1968, is directed to a pouring spout wit a flat bottom and upright sides which fits into the groove on the top of a paint can.

U.S. Pat. No. 3,252,635 entitled "Extension Collar For Liquid Containers Such As Paint Cans", issued May 24, 1966, describes a flexible collar which fits into the groove of a paint can.

U.S. Pat. No. 3,309,000 entitled "Can Extender and Pourer", issued Mar. 14, 1967, is directed to a device which fits into the groove on the top of the paint can and provides a pourer.

U.S. Pat. No. 3,463,366 entitled "Paint Can Attachment Ring With Pouring Lip", issued Aug. 26, 1969, is directed to a pourer which fits into the groove of a paint can.

U.S. Pat. No. 3,679,103 entitled "Combination Carrying Handle and Pour Spout", issued July 25, 1972, is directed to a device which can be attached to the wire handle of a paint can, or attached to the can proper to act as a pourer.

U.S. Pat. No. 3,695,488 entitled "Container Spout", issued Oct. 3, 1972, is directed to a groove mounted pouring spout.

U.S. Pat. No. 3,822,812 entitled "Pouring Attachment For Paint Cans", issued July 9, 1974, is directed to a V-shaped device which causes the paint to pour from the tipped can in a well defined stream.

U.S. Pat. No. 3,844,457 entitled "Paint Can Pour Spout With Brush Support and Attachment", issued Oct. 29, 1974, is directed to a device which fits into the groove of a paint can.

U.S. Pat. No. 3,853,249 entitled "Pouring Spout For Cans", issued Dec. 10, 1974, is yet another rim type pourer attachment.

U.S. Pat. No. 3,899,107 entitled "Paint Can Adaptor", issued Aug. 12, 1975, is directed to a device which fits into the groove on a paint can.

U.S. Pat. No. 4,014,465 entitled "Paint Can Pour Spout", issued Mar. 29, 1977, is directed to a spout arrangement.

U.S. Pat. No. 4,203,537 entitled "Paint Can Accessory", issued May 20, 1980, is directed to a pourer with a flat bottom which is mounted on the rim of a paint can.

U.S. Pat. No. 4,299,340 entitled "Paint Can Attachment", issued Nov. 10, 1981, is a spout device which does not provide a wall around the paint can.

U.S. Pat. No. 4,369,890 entitled "Paint Can Collar", issued Jan. 25, 1983, is a collar which fits onto the rim of a pain can.

U.S. Pat. No. 4,736,874 entitled "Apparatus For Use On Open-Mouth Cans For Pouring Liquid Therefrom", issued Apr. 12, 1988, is directed to a two piece collar insert/spout device.

SUMMARY OF THE INVENTION

None of the art cited above provides an inexpensive multi-part paint can attachment. Applicant has provided a paint can attachment which may be easily attached to an open paint can or other type of can which will prevent the liquid from getting into the rim channel. Separate additional parts may be snap:fit to the basic attachment to provide a pourer spout and a brush scraper bar for scrapping excess liquid from brushes. One embodiment of the invention provides a splash guard which prevents liquid from splashing out of the can. The invention is attached to the can using downwardly extending protuberances which are frictionally fitted into the rim channel. Another embodiment of the invention uses a downwardly extending channel rib which is frictionally fitted into the rim channel.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
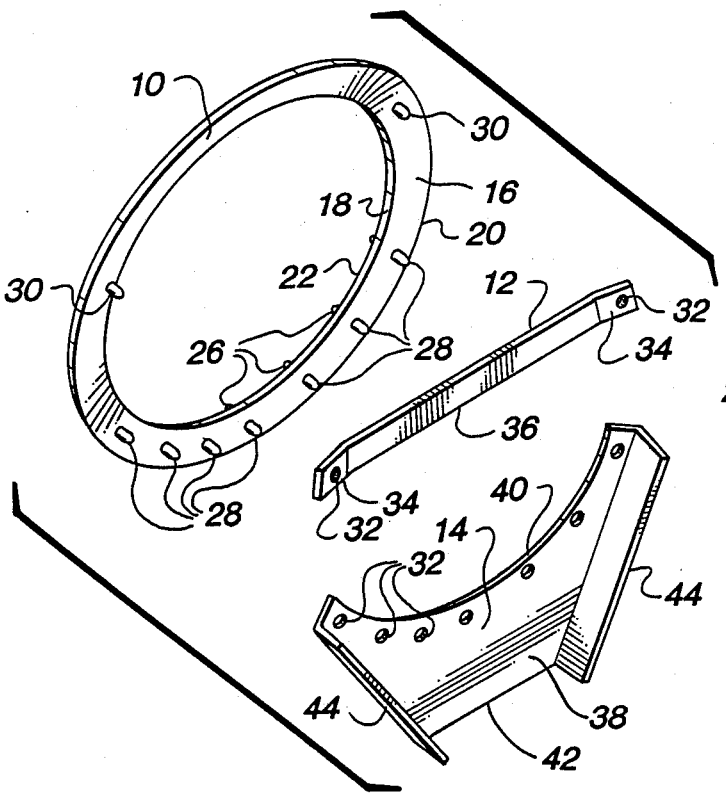
FIG. 1 is an exploded view of the preferred multipart embodiment of the invention, shown disassembled.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

Referring now to the exploded view of the Paint Can Attachment shown in FIG.1, the disassembled pieces comprise a paint can rim ring generally designated 10, a paint brush scraper bar generally designated 12 and a pourer spout generally designated 14. The individual pieces may be made of plastic, metal or other material, and are designed to snap-fit together. While the invention is discussed with reference to paint cans, it should be understood that the invention may be used with any type or size of can that contains paint or other liquid. The paint can rim ring 10 has a top side 16 and a bottom side 18. It also has an outside rim 20 and an inside rim 22 with the outside rim being higher than the inside rim. This provides a sloped surface which is used to prevent paint or other liquid from getting into the can's recesses lid sealing section or rim channel (shown at 24 in FIG. 2) as will be described in more detail below. Ring 10 is provided with a plurality of downwardly extending nodules or protuberances 26 which are positioned around the circumference of the ring 10 and are used to attach the ring to the can's rim channel 24. Nodules 26 may take a variety of shapes depending on the shape of the rim channel. In the preferred embodiment the downwardly extending nodules 26 are designed to wedge securely into the can's rim channel 24, although they may also be designed to snap-fit into the rim channel, depending on the type of can. Several of the nodules 28, 30 also extend upwardly from the top side 16 of ring 10. One such set is shown at 28, another is shown at 30. The nodules 30 are designed to snap fit with the brush scraper bar 12 via attachment holes 32. Similarly, the pourer spout 14 snap-fits with nodules 28 via attachment holes 32.

Brush scraper bar 12 has angled end portions 34 which slightly lower the intermediate level portion 36 of the bar. This aids in keeping paint from splattering, and provides a more securly fastened bar 12.

The pourer spout 14 has a flat apron section 38 which is curved at the back 40 to mate with ring 10. The sides are angled to narrow the spout at its front end 42 for ease of pouring. Splash guard walls 44 are provided to prevent spillage while pouring. The splash guard walls 44 act to funnel the paint toward the front end 42.

Figure 2:
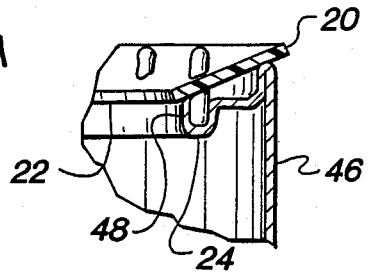
FIG. 2 is a fragmentary sectional detail view of the ring portion 10 of FIG. 1, shown attached to the rim of an open paint can.

Referring now to FIG. 2, a portion of the ring 10 is shown attached to a can 46. The slope of the top side of ring 10 is more clearly shown in this Figure. The inside rim 22 of ring 10 slightly overhangs the inside edge 48 of the can 46, thereby acting to prevent liquid such as paint from getting into the rim channel 24. FIG. 2 also shows that the upwardly extending nodules 28 and 30 are slightly bulbous in shape so as to snap-fit with attachment holes 32.

Figure 3:
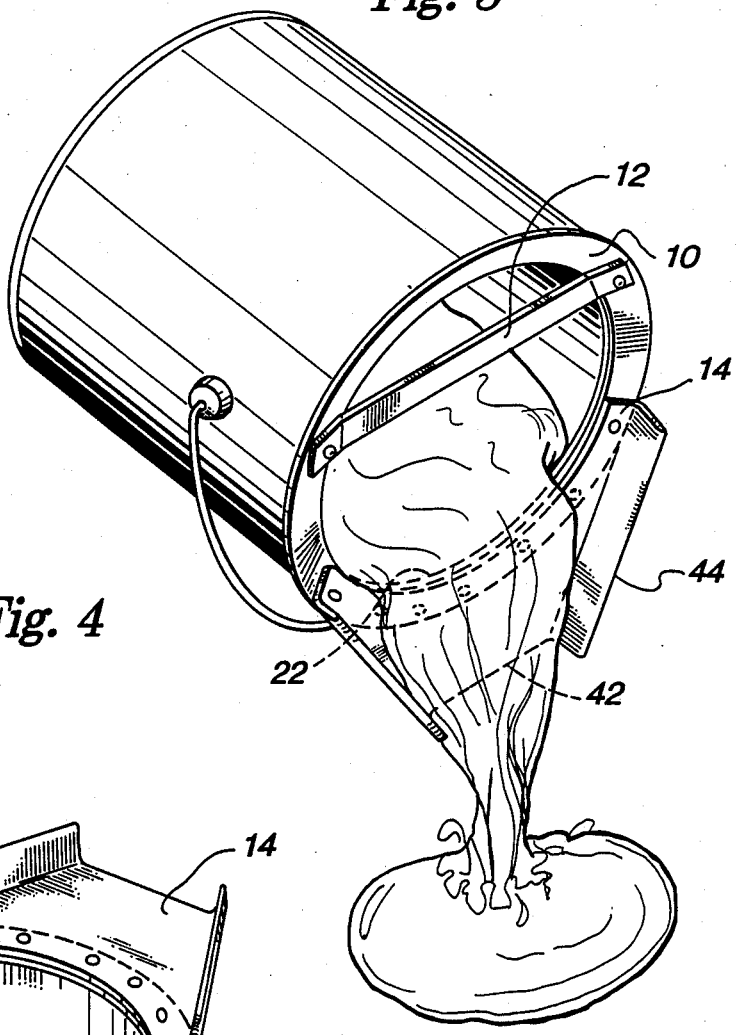
FIG. 3 is a perspective view of an open paint can with the invention attached thereto, shown in a tipped pouring position.

Referring now to FIG. 3 the invention is shown assembled and attached to an open paint can. As the can is tipped, the paint flows over the innver edge 22 of the ring 10, is guided by the splash guard walls 44 and pours over the front edge 42 of the pourer spout.

Figure 4:
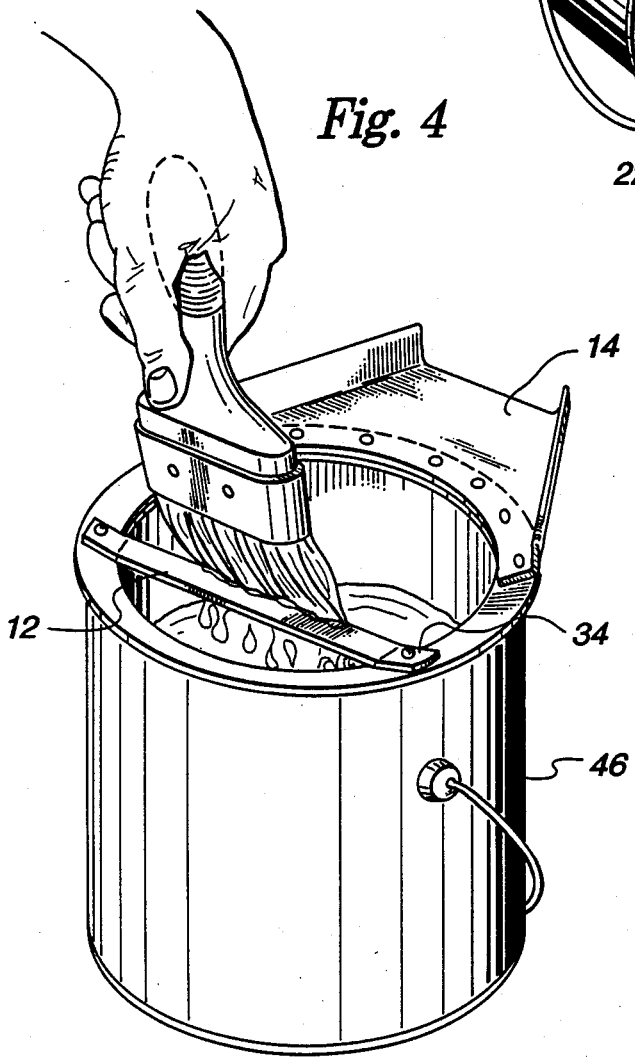
FIG. 4 is a perspective view of an open paint can showing the use of the paint brush scraper bar attachment of the invention.

Referring now to FIG. 4 it can be seen that the paint scraper brush bar 12 operates to strip excess paint or other material from a brush, while keeping the rest of the can and ring clean.

Figure 5:
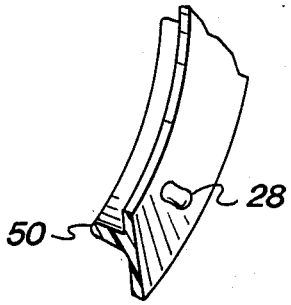
FIG. 5 is a fragmentary perspective detail showing an alternative embodiment of FIG. 2.

Referring now to FIG. 5 an alternative design for attaching the ring 10 to the can 46 is shown. Instead of using a plurality of downwardly extending nodules 26, a channel rib 50 is used. Channel rib 50 is designed to frictionally frit rim channel 24. Upwardly extending nodules 28 and 30 are still used for attaching the bar 12 and the pourer spout 14 to ring 10.

Figure 6:
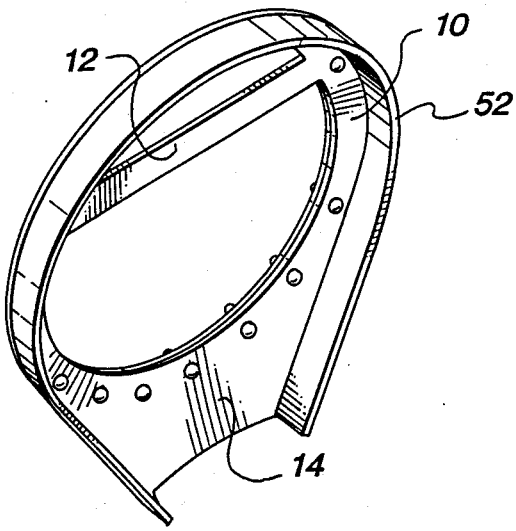
FIG. 6 is a perspective view of an alternative embodiment showing a splash guard.

Referring now to FIG. 6 an alternate embodiment of the invention is shown fully assembled. This embodiment includes a splash guard 52 which extends around the entire circumference of the ring 10 and the spout 14. It is also contemplated that the entire invention may be manufactured as one piece using molded plastic.

This completes the description of the preferred and alternate embodiments of the invention. Those skilled in the art may recognize other equivalents to the specific embodiment described herein which equivalents are intended to be encompassed by the claims attached hereto.

What is claimed is:

1. An attachment for use with an open can having a rim channel about its opening, the attachment comprising:

a peripheral attachment element having a topside surface, an underside surface, and inner and outer edges therebetween, the attachment element being constructed such that the outer edge is higher than the inner edge whereby the topside surface is sloped when it is attached to the can, and a plurality of rim channel engaging protuberances extending downwardly from the underside surface of the attachment element, the protuberances being positioned between the inner and outer edges of the underside surface of the attachment element such that the inner edge of the attachment element extends into the can when the element is attached to the can rim channel;

a spout attachment having a front, back and sides with a plurality of mating openings positioned near the back of the spout attachment designed to easily snap-fit mating protuberances, the spout attachment including funnel walls extending upwardly along the spout attachment sides for ease in guiding and pouring the liquid, and a plurality of spout engaging protuberances extending upwardly from the topside surface of the attachment element for engaging the spout attachment, whereby, upon attachment of the peripheral attachment element, liquid is prevented from entering the rim channel.

2. The attachment of claim 1 further including:

two protuberances extending upwardly from the topside surface of the attachment element and positioned such that a paint scraper bar having mating openings at either end may be snap-fit thereto.

3. The attachment of claim 1 further including:

vertically extending splash guards extending over the portion of the circumference of the attachment element and on either side of the spout attachment.

4. The attachment of claim 2 further including:

vertically extending splash guards extending over the portion of the circumference of the attachment element and on either side of the spout attachment.

5. A paint can attachment for use with a paint can having a rim channel comprising:

a ring shaped element having a topside surface, an underside surface, and inner and outer edges, the ring element being constructed such that the outer edge is higher than the inner edge so that the topside surface is sloped when it is attached to the can;

a plurality of rim channel engaging protuberances extending downwardly from the underside surface of the ring shaped element, the protuberances being positioned between the inner and outer edges of the underside surface of the ring shaped element such that the inner edge of the ring shaped element extends into the can when the attachment is attached to the can;

a plurality of spout engaging protuberances extending upwardly from the topside surface of the ring shaped element;

a spout having a front, back and sides with a plurality of mating openings positioned near the back of the spout designed to easily snap-fit onto the spout engaging protuberances and wherein the spout includes funnel walls extending upwardly along the spout sides for ease in guiding and pouring the paint, and two protuberances extending upwardly from the topside surface of the ring shaped element positioned such that a paint scraper bar having mating openings at either end may be snap-fit thereto, whereby when the ring shaped element is fitted into the paint can rim channel using the downwardly extending protuberances the ring shaped element prevents paint from entering the rim channel.

6. The paint can attachment of claim 5 further including vertically extending splash guards extending over the portion of the circumference of the ring shaped element and on either side of the spout.

7. A paint can attachment for use with a paint can having a rim channel comprising:

a ring having a topside surface, an underside surface, and inner and outer edges, the ring being constructed such that the outer edge is higher than the inner edge so that the topside surface is sloped when it is attached to the can, where the inner edge of the ring extends into the can forming a seal to prevent paint from entering the rim channel;

a downwardly extending channel rib attached to the underside surface of the ring, the rib being positioned between the inner and outer edges of the underside surface of the ring such that when the paint can attachment is attached to the can the inner edge of the ring extends into the can;

a plurality of spout engaging protuberances extending upwardly from the topside surface of the ring;

a spout having a front, back and sides with a plurality of mating openings positioned near the back of the spout designed to easily snap-fit onto the spout engaging protuberances and wherein the spout includes funnel walls extending along the spout sides for ease in guiding and pouring the paint, and two protuberances extending upwardly from the topside surface of the ring and positioned such that a paint scraper bar having mating openings at either end may be snap-fit thereto, whereby when the ring is fitted into the paint can rim channel using the downwardly extending portuberances the ring prevents paint from entering the rim channel.

8. The paint can attachment of claim 7 further including vertically extending splash guards extending over the portion of the circumference of the ring and on either side of the spout.

* * * * *

UNITED STATES PATENT AND TRADEMARK OFFICE

CERTIFICATE OF CORRECTION

PATENT NO. : 4,911,319

DATED : March 27, 1990

INVENTOR(S) : Milton V. DeJean

It is certified that error appears in the above-identified patent and that said Letters Patent is hereby corrected as shown below:

Col. 3, line 30, delete "securly" and insert - securely-

Col. 3, line 49, delete "innver" and insert - inner -

Signed and Sealed this

Twenty-third Day of July, 1991

*Attest:*

*Attesting Officer*

HARRY F. MANBECK, JR.

*Commissioner of Patents and Trademarks*